US006742305B2

(12) United States Patent
Rogers et al.

(10) Patent No.: US 6,742,305 B2
(45) Date of Patent: Jun. 1, 2004

(54) FIRE PROTECTION COVER APPARATUS FOR STRUCTURES

(76) Inventors: William Rogers, 7564 W. Louisiana Ave., Lakewood, CO (US) 80232; Christie Holliday, 7564 W. Louisiana Ave., Lakewood, CO (US) 80232

( * ) Notice: Subject to any disclaimer, the term of this patent is extended or adjusted under 35 U.S.C. 154(b) by 33 days.

(21) Appl. No.: 10/273,084

(22) Filed: Oct. 18, 2002

(65) Prior Publication Data

US 2004/0074152 A1 Apr. 22, 2004

(51) Int. Cl.[7] ..... E04B 1/34; E04H 9/00; E04D 5/00

(52) U.S. Cl. ..... 52/3; 52/5; 52/DIG. 12; 169/48; 169/51; 160/23.1

(58) Field of Search ..... 52/3, 5, DIG. 12; 169/48, 51; 160/23.1

(56) References Cited

U.S. PATENT DOCUMENTS

| | | | | |
|---|---|---|---|---|
| 3,715,843 A | | 2/1973 | Ballinger | |
| 3,766,958 A | * | 10/1973 | Mitchell | 160/84.02 |
| 3,877,525 A | * | 4/1975 | Husson et al. | 169/48 |
| 4,858,395 A | * | 8/1989 | McQuirk | 52/3 |
| 5,022,452 A | * | 6/1991 | Burrell | 160/7 |
| 5,608,992 A | * | 3/1997 | Floyd | 52/3 |
| 5,829,200 A | * | 11/1998 | Jones et al. | 52/3 |
| 5,896,907 A | * | 4/1999 | Dever et al. | 160/6 |
| 6,070,640 A | * | 6/2000 | Miyagawa et al. | 160/121.1 |

FOREIGN PATENT DOCUMENTS

| | | | | |
|---|---|---|---|---|
| GB | 2108839 | * | 5/1983 | A62C/3/14 |

* cited by examiner

*Primary Examiner*—Robert Canfield

(57) ABSTRACT

An apparatus, a wildfire protection method for houses and other structures from the destructive forces of a wildland fire. The current form of the preferred embodiment consists of a highly fireproof material, which is pre-fitted to cover each area of structure including gables or dormers one section at a time. The material is contained on a fireproof deployment apparatus such as a roller means having a retractable mechanism. The deployment apparatus is contained and secured within a housing, this housing being supported by firmly mounting it to strategic areas of the architectural structure. Once installed, deployment of the fireproof covering material is accomplished by unrolling the material from one side of the fireproof deployment apparatus. Each pre-fitted section of fireproof material contains reinforced edges, which are fitted with multiple fasteners by which to attach one section of said fireproof material to another as each is deployed from a series of apparatus. Each section of material is deployed in sequence and fastened to other nearby sections. The fireproof material once deployed by sections and fastened over the entire structure will provide protection from the high heat and burning embers associated with wildfires. Total structure coverage is accomplished very quickly by using several of these apparatus in series, each of which are strategically attached to the structure architecture.

19 Claims, 4 Drawing Sheets

20
21

19
17
18
22
21

23
24
21
18
22
25

FIRE PROTECTION COVER APPARATUS FOR STRUCTURES

BACKGROUND—FIELD OF INVENTION

There is the severe lack of quickly and easily deployable exterior fire protection for homes and other structures in the path of a wildfire. A very great need is apparent for a re-usable, affordable covering means that will not loose its fire protection properties even when deployed for many days in any type of weather.

BACKGROUND—DESCRIPTION OF THE RELATED ART

There are two possible sources that will cause a home to ignite during a wildland fire: either from direct flames and/or from firebrands accumulating directly on the home. Even the large flames of high intensity do not directly ignite homes at distances beyond 200 feet. Fires adjacent to a home do not ignite it and firebrands can only ignite a home through contact.

The prevalence of wildfires around the country remains a significant public concern. Hundreds of homes and outbuildings in several states have been lost this year alone. While firefighters try to do their best to protect homes and other structures, the time spent doing so only serves to detract their attention and give the wildfire more time to grow.

Charging firefighters with the role to protect homes within the fire area draws them away from an offensive role of battling the fire into a defensive role of protecting homes from the fires. This adds a great deal of risk to their efforts and to the operation itself. Homes are sources of fuel for a wildland fire. If several homes catch fire, the intensity of the fire is magnified, threatening even more homes and wildland. Because so many firefighters, fire trucks, and airborne resources are focused on a single fire, other areas may be left shorthanded. All too often during periods of high fire danger, other fires are likely to start. These other fires may bum unrestrained because firefighters committed to a wildland fire threatening homes will not be released to fight a fire that is burning in unpopulated wildlands.

The insurance companies have had to pay claims in the billions of dollars due to wildfire losses. The United States Department of Forestry and indeed even the President of the United States are looking for ways to minimize wildland fire damage. With weather changes becoming more prevalent bringing less snow pack and rainfall, drought conditions are continuing to grow and we can expect many more wildfires in the future. The economic cost of wildland fires is staggering and a serious national problem. Resulting high costs of home replacement and displaced lives warrant a much closer look at a solution for this ongoing danger.

In conjunction with proper vegetation clearing in the nearby structure area, the present invention has potential to reduce home and out building ignition as well as to help improve emergency wildland-urban fire response strategy and tactics.

Given the hazardous conditions created by wildfires, the owner of a home or other structure at this time has little recourse for home and out-building protection. Apart from proper clearing of brush and close trees, currently the only means of accomplishing home protection during a wildfire is through application of fire retardant chemicals, which can be sprayed onto the structure. There are also fire retardant chemicals, which can be added to paints, or built into the construction materials. But these will still catch fire in the face of high heat or burning embers. For the homeowner, keeping an appropriate amount of chemical sprays on hand for rapid dispensing could be prohibitive both financially and with regard to actual physical safety during deployment of these chemicals. Most of the time it is up to fire fighters to treat the houses with retardant after determining which structures have a chance of being saved.

Extensive research shows that successful development and commercialization of a reliable and readily accessible process or apparatus to protect structures against a wildland fire has never been achieved. A thorough on-line literature search revealed no published information about the existence of or successful development of a home protection process of the type we propose.

Articles on various fire chemical retardants were found, and also literature from a company who is planning to sell rolls of material that can be wrapped around the structure before the fire comes. According to the company, "the material expands when exposed to fire to form a "cocoon" around the entire structure." However, no documentation is available to show that it actually works, nor are any photos available to help prove that a house can be adequately wrapped in this way.

According to our calculations, one would have to have 24 rolls of the wrap at 30 lbs per roll just to cover a 1500 square foot house. Each roll is 4 ft. wide×50 ft. in length. After wrapping the house, a way would have to be devised to somehow close the edges of the material to form a barrier against the high winds, and airborne glowing embers present in wild fire conditions. The material is only said to last for 5 years and must be stored in a dry area. No pricing was available at the time we last checked. We feel that the chances of a homeowner actually trying to wrap his home as protection against wildfire are highly unlikely.

An example of an invention to accomplish structure protection is in U.S. Pat. No. 3,715,843 by Virgil Ballinger, Aug. 23, 1971 with his fire protection apparatus for a building. The present invention has similar objects or goals as the U.S. Pat. No. 3,715,843, however is approached differently using a non complex and permanent method. The common goal is to provide a cost effective and easy to use flame resistant structure cover. Although U.S. Pat. No. 3,715,843 has its merits, the cumbersome design, complicated use, time to install and inability to be permanently attached to a structure for immediate deployment speaks to the fact that U.S. Pat. No. 3,715,843 could never provide the user with convenience in protecting a structure. Indeed, simply finding the appropriate material in the appropriate size and then locating a crew and the overhead pulleys, booms, winches and other miscellaneous components needed for installation while a wildfire is on it way would certainly prove to be a challenge if not entirely unfeasible.

No specific prior art that is similar to the present invention in the specific design and purpose has been found. There is prior art that provide uses for similar mechanisms or apparatus, but not for the objective of the present invention. We have found no previous patents, which achieve or fulfill the purposes of the present invention.

The present invention has been developed to meet the requirements of ease of operation, ease of installation and cost-effectiveness. The present invention is intended to be permanently installed on the architecture of a structure and can be deployed or retracted with ease at any time. The apparatus system envisioned within the present invention will be customizable for each structure. This customization is accomplished by installing the apparatus of the present invention in series. The number of apparatus installed is determined by structure size, architecture and need. When fully deployed and all sections of material from all apparatus are connected, the resulting cover fully envelopes the structure for optimum protection. The present invention can also be used to protect decks and miscellaneous out buildings, such as garages, stables, and barns during a wildfire. The cost of the invention should be affordable to most homeowners or building owners.

Through utilizing the fireproof cover apparatus of the present invention, it is conceivable that the economic load on insurance, public and government agencies could be greatly decreased. Lives, investments and memories could be more readily preserved.

BRIEF SUMMARY OF THE INVENTION

This invention relates to an original design for protecting homes and other structures from the devastating effects of wildland fire including glowing ash and firebrands. The process uses a series of easily deployed; pre-fitted covering material segments which when joined together will envelop the entire structure. This covering will be secure enough to last in a deployed position indefinitely, and will be retractable and reusable for many years. The entire system will be permanently attached to the architecture of the structure for immediately available deployment at any time. It is important to note that the deployment mechanism can use many variations of existing technology.

A lightweight highly fireproof material is secured at one end to a fireproof rigid circular element such as a heat resistant rod at one end.

The rigid circular element is encased within a fireproof housing, which is secured to the architecture of a structure.

The fireproof material is then extended off the roller and pulled over the section to be covered.

The material contains flaps at its outer edges on all sides of the fireproof material. These flaps extend beyond the boundaries of the main cut of the fireproof material. Each flap is designed to connect to an adjacent section of fireproof material from an adjoining covering apparatus of the present invention. Both the flap and the adjoining section of material contain a connection means to secure it on all sides to other connection points from nearby covering apparatus of the present invention.

Due to the fact that many structures have gables and dormer type architecture, which are obtrusive but will need to be covered during deployment, pre-sized pouches will be created through aligning pre-cut flaps provided within the fireproof material to quickly accomplish this.

These pre-fitted covering material segments when fitted together will cover the entire structure and create a strong barrier against glowing embers and firebrands that are present during wildfires.

A variety of lightweight fireproof materials exist on the market today such as NOMEX and KEVLAR, which are used in such things as firefighter clothing and in bulletproof vests. Unlike flame-retardant treated materials, NOMEX fibers are inherently flame resistant. The flame resistance is a natural property of the polymer chemistry. It will not diminish during the life of the fiber and NOMEX does not melt or drip. When NOMEX is used in conjunction with KEVLAR, excellent resilience and tear resistant qualities are available. Still other products exist on the market such as ZetexPlus, and several silica based products. Many of these high quality flame resistant materials are inexpensive and provide the necessary qualities required for the manufacture of the present invention.

LIST OF REFERENCE NUMERALS

Figure 1:
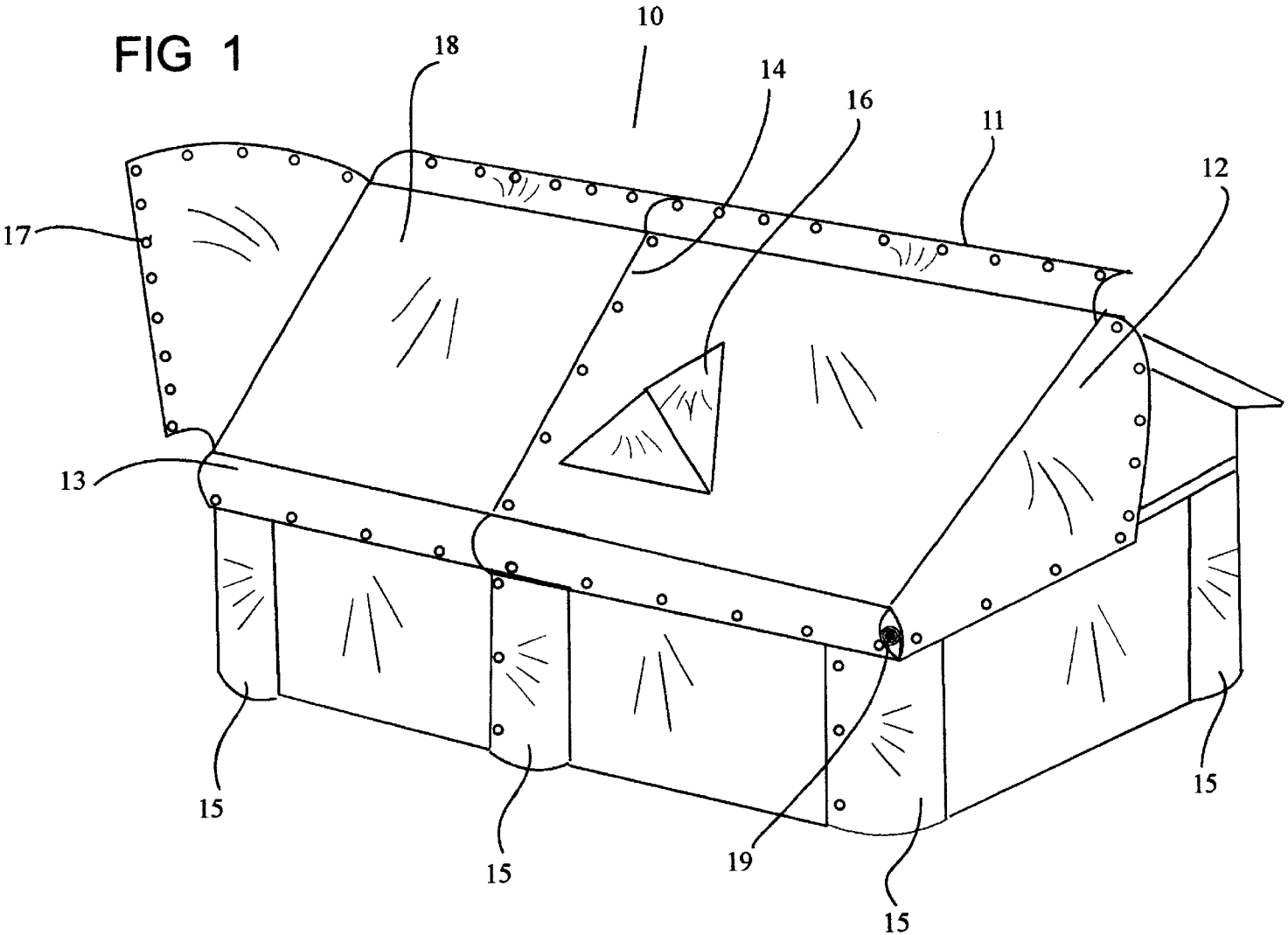
FIG. 1, is a three dimensional view of the installed preferred embodiment of the fireproof cover apparatus used in series with other of the same apparatus to show the invention in the partially deployed position.

10 Present Invention
11 Ridge Flap
12 Gable End Flap
13 Eaves Flap
14 Roof Overlap Flap
15 Elevation Flap
16 Dormer Covering
17 Connection Means
18 Fireproof Material
19 Apparatus of the Present Invention
20 Roller Spring Mechanism
21 Rigid Circular Element
22 Reinforced Material Edge
23 Housing
24 Hinge
25 Closure Means
26 Roof Architecture
27 Roof Ridge
28 Gable end
29 Eaves
30 Side Elevation
31 End Elevation
32 Housing End Closure
33 Dormer

DETAILED DESCRIPTION OF THE INVENTION

A fireproof cover apparatus for protecting structures in the path of a wildland fire, which embodies the concepts, and principles of the preferred embodiment of the invention is shown in the following illustrations.

Referring now to the drawings wherein the showings are for the purpose of illustrating the preferred embodiment of the invention only, and not for the purpose of limiting the same.

FIG. 1 shows the fireproof cover apparatus 10, installed in series on a structure and partially deployed and secured. The connector means 17, is utilized to secure the ridge flap 11, gable end flap 12, eaves flap 13, roof overlap flap 14, and elevation flap 15, to adjoining connection points on adjacent apparatus of the present invention. Connecting all flaps creates the fully sealed fire protection cover. The materials to be used for the fireproof cover apparatus are only limited by their strength, heat resistance, weight, and costs. The preferred material of construction for the fireproof material is a NOMEX and KEVLAR blend due to the high heat and tear resistance and low cost. Other types of fireproof material that have sufficient strength to withstand the heat and high winds created during a wildfire are also available.

Figures 2, 2A, 3:
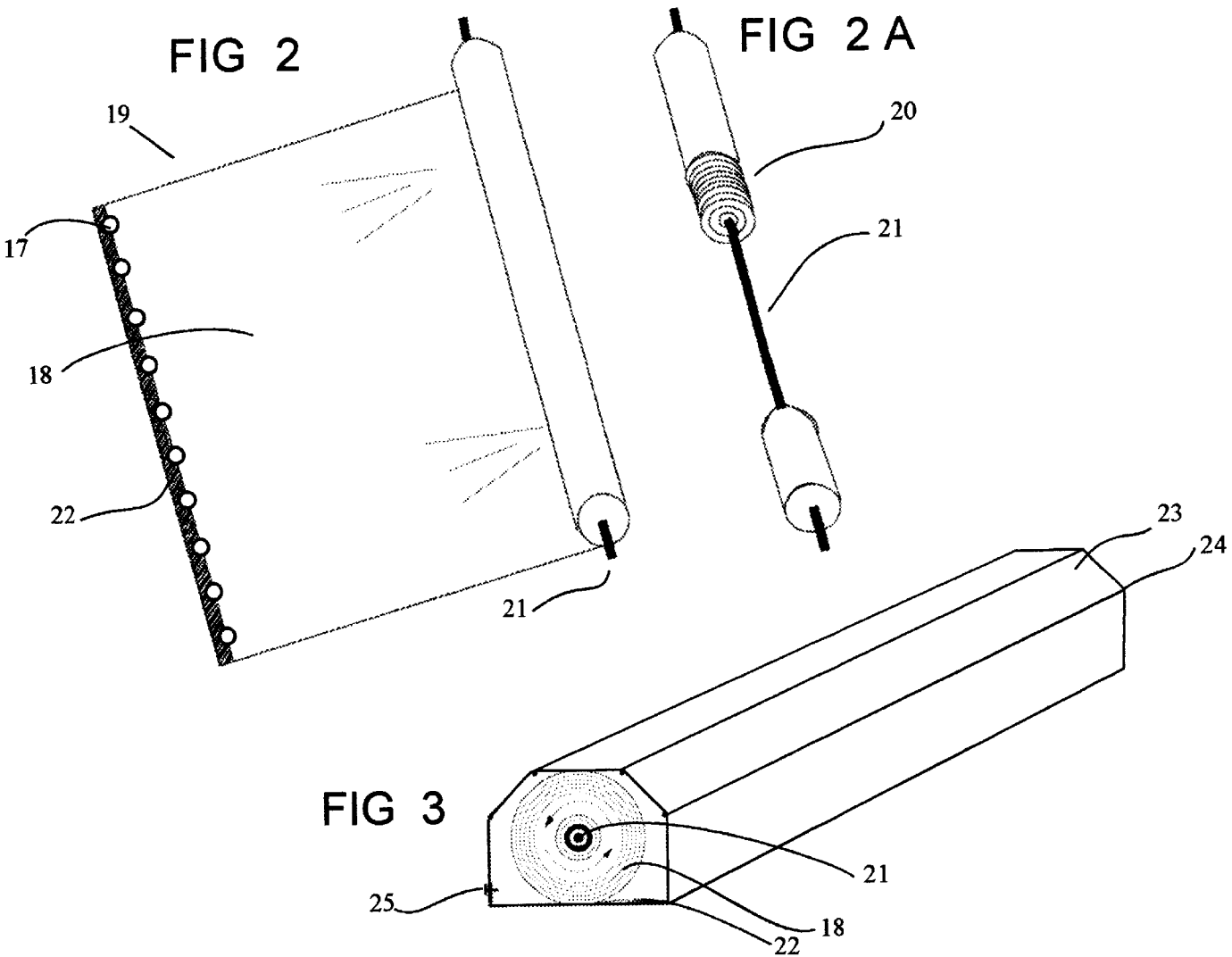
FIG. 2, is a three dimensional view of the preferred embodiment of the deployment means and attached fireproof material.
FIG. 2A, is a three dimensional view of the preferred embodiment to illustrate the rotary deployment mechanism type.
FIG. 3, is a three dimensional view of the preferred embodiment of the deployment mechanism and fireproof material enclosed inside the collapsible housing.

In FIG. 2, the fireproof cover apparatus 19, is extended to show the fireproof material 18, connected to the rigid circular element 21 and the retractable roller spring mechanism 20. The reinforced material edge is shown with connection means 17, in place to illustrate a method for attaching one section of fireproof material to another.

In FIG. 2A, the rigid circular element 21, is shown with the retractable spring mechanism 20, to illustrate the preferred method of extending and retracting the fireproof material. There are many retractable deployment apparatus on the market with mechanisms that can be adapted for use with the present invention.

In FIG. 3, the collapsible housing 23, is shown with the fireproof material 18, in the retracted position contained inside. The collapsible housing 23, contains hinges 24, which are placed in series to create movable panels on all sides of the collapsible housing 23. The collapsible housing 23, is opened through use of a latch means 25. The latch means is unlatched at one side and manually opened to collapse the housing. For clarity, the end closures 32 of the housing are not illustrated in FIG. 3.

Figure 4:
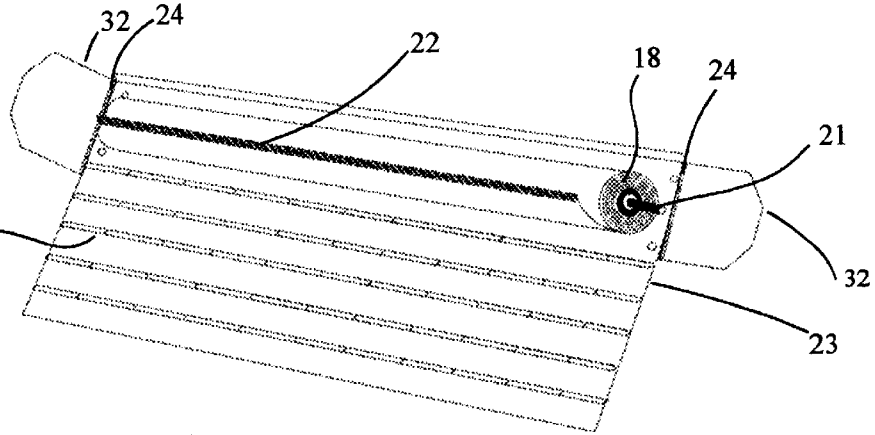
FIG. 4, is a three dimensional view of the preferred embodiment of the deployment mechanism and fireproof material shown with the collapsible housing open.

In FIG. 4, the fully open housing 23, with the fireproof material 18, in the non-deployed position is illustrated. The hinges 24, are shown in series to demonstrate a means for collapsing the housing 23. The housing end closures 32, are also collapsible every part of the housing 23, collapses so that it lies perfectly flat to serve the dual purpose allowing efficient deployment operation, to allow all sections of material to be connected without hindrance and to allow the material to cover the collapsed housing itself.

Figure 5:
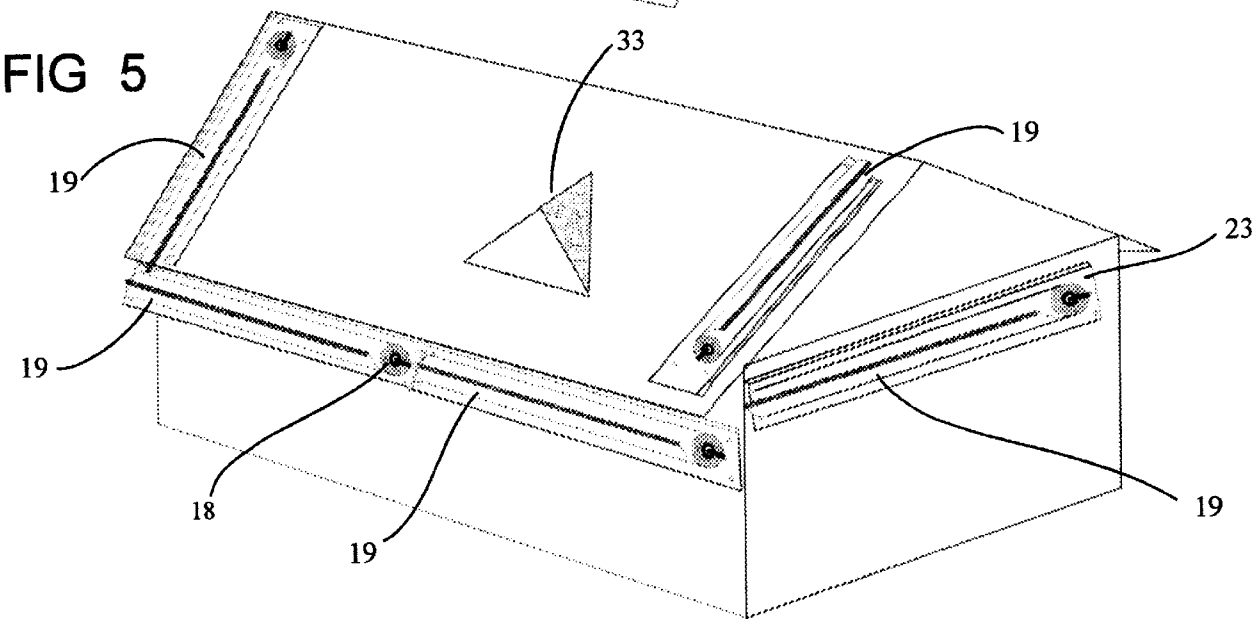
FIG. 5, is a three dimensional view of the preferred embodiment showing the apparatus of the present invention installed on a structure to illustrate architectural placement of the apparatus in series.

In FIG. 5, several apparatus of the present invention 19, are shown in series, as is the intended use of the present invention, and installed in strategic locations on the architecture of a structure. The housing 23, is completely open and rigidly secured to the structural architecture by a suitable fastening means in such a manner that the axis of the rigid circular element 21 is generally perpendicular to the roof ridge 27. The sides of the housing 23 are removed from this figure for purposes of illustration. The fireproof material 18, is shown but not yet deployed. A dormer 33, is shown for continuity purposes in reference to FIG. 1.

Figure 6:
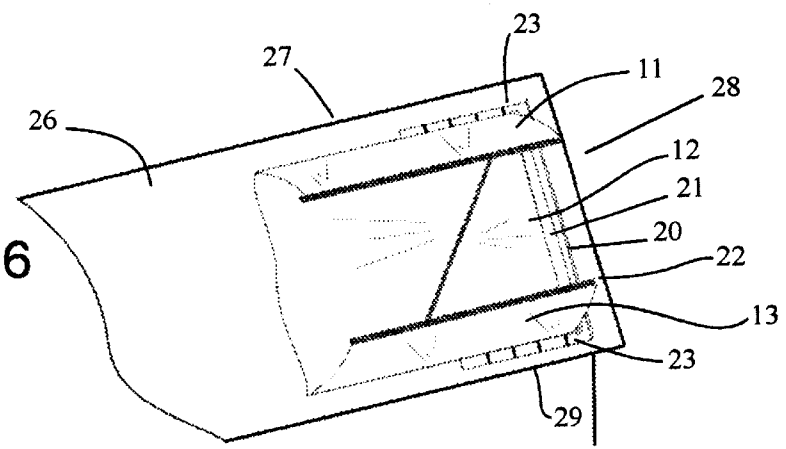
FIG. 6, is a three dimensional view showing one apparatus of the present invention installed on a structure with the apparatus housing collapsed and flaps partially deployed.

In FIG. 6, the open position of the cover apparatus of the present invention 19, is shown to illustrate the operational process. When cover apparatus of the present invention 19, is initially installed or is not in use, FIG. 6 illustrates the current position of the cover apparatus of the present invention 19, as it relates to the roof 26, of the structure. The fireproof material 18 is illustrated in a partially deployed unwound position to demonstrate how the various sections of the fireproof material can be arranged relative to each other when wound on the rigid circular element 21 and contained in the housing 23. The ridge flan 11 is folded over onto the portion of the fireproof material adapted for covering the roof such that the associated fold line is generally parallel to the roof ridge 27. When ridge flap is deployed and unfolded, it is adapted to be secured to a corresponding edge of the fireproof material of an adjacent apparatus 19 that is located on the opposite side of the roof ridge.

The gable end flap 12 is folded over the portion of the fireproof material covering the roof and lies flat against the portion of the fireproof material adapted for covering the roof (1) when the gable end flap is wound onto the rigid circular element 21 and (2) after being unwound but not deployed. The gable end flap 12 is attached to the portion of the fireproof material adapted for covering the roof at an associated fold line located proximate a location where the fireproof material attaches to the rigid circular element 21, such that the associated fold line is generally perpendicular to the roof ridge 27. The gable end flap deploys to overlap the gable end 28, and the portion of the housing to the right of the fold line thereby covering the rigid circular element 21, and the retractable roller spring mechanism 20. The deployed and unfolded gable end flap 12 can be secured to the material connection points of the end elevation 31, which will be located on an adjacent apparatus of the present invention 19, at the top of the corresponding side elevation 30.

The eaves flap 13 is folded over onto the portion of the fireproof material adapted for covering the roof such that the associated fold line is generally parallel to the adjacent eaves 29. When deployed and unfolded, the eaves flap 13, deploys to overlap the eaves 29, so that it can be secured to the connection points on the fireproof material located on an adjacent apparatus of the present invention 19, which is installed at the base of the eaves.

Figure 7:
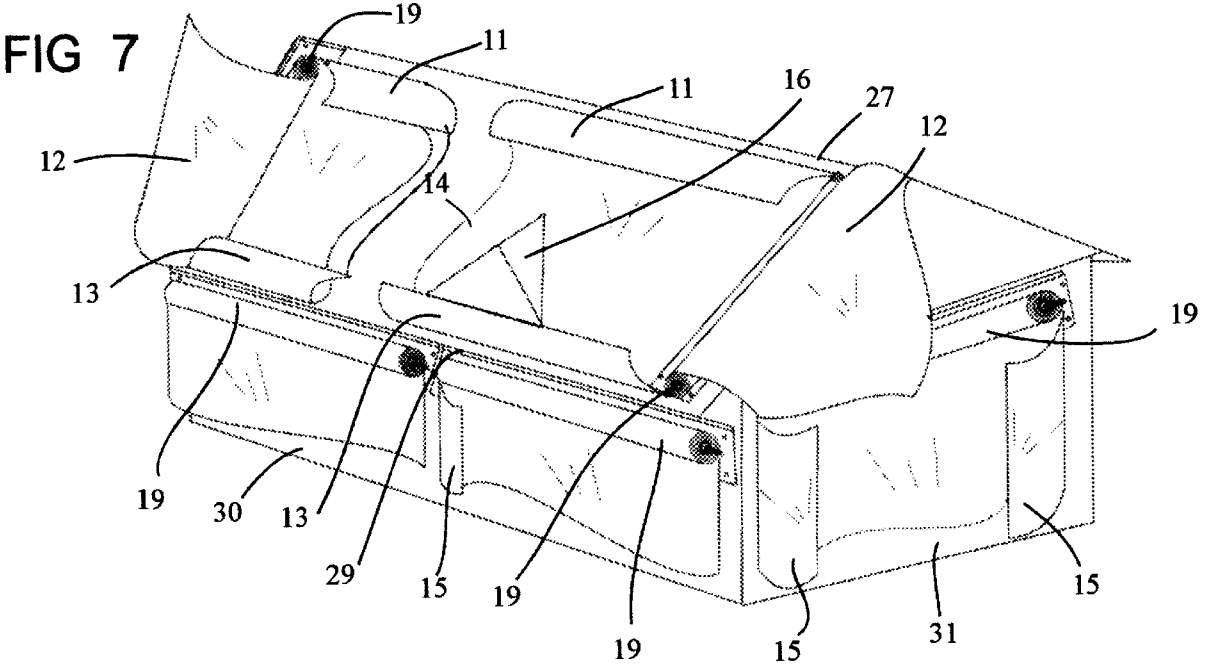
FIG. 7, is a three dimensional view of the preferred embodiment of the apparatus that is installed in series on the roof and along the sides of a structure in the semi-deployed position to illustrate the operations of the protective cover apparatus and to demonstrate the use of the apparatus in series.

In FIG. 7, the apparatus of the present invention 19, is shown installed in series in the semi-deployed position with an optional dormer cover 16, which can be built in to the material or installed separately. This illustration additionally shows the elevation flap 15, deployed to overlap the material connection points of an adjacent apparatus of the present invention 19, on the side elevation 30.

The gable end flap 12, deploys to overlap the installed end elevation 31, installed apparatus of the present invention 19, and is secured by a connection means to the material of the installed end elevation apparatus.

The eaves flap 13, deploys to overlap the installed side elevation apparatus of the present invention 19, and is secured by a connection means to the material of the installed side elevation apparatus.

The ridge flap 11, deploys to overlap the roof ridge 27. After overlapping the roof ridge 27, it is secured by a connection means to the material of a similar apparatus of the present invention 19, on the opposite side of the roof.

The roof overlap flap 14, is secured by a connection means to the material of a similar apparatus of the present invention 19, on the adjacent side of the roof.

The gable end flap 12, eaves flap 13, elevation flap 15, roof overlap flap 14, and ridge flap 11, are all shown partially deployed and in position for fastening to the material of a similar adjacent apparatus of the present invention 19. When all flaps are deployed and fastened together, a secure, fireproof cover is created for protection of the exterior of a structure.

The reader can see that the apparatus of the present invention 19, of the preferred embodiment of the invention provides an easy to use and install wildfire protection cover for any structure. It is made from high strength material to protect against the high winds encountered in a wildland fire and through use of new and innovative materials, provides enough heat resistant capability to greatly enhance the survival of any structure on which it is installed. The installation and operation of the present invention are simple. This fireproof cover requires neither tools nor special skills to deploy. This ease of use is what is needed in a situation, which requires quick and efficient structural protection.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application thereby enabling one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

We claim:

1. A fireproof cover apparatus for shielding a structure during wildfire conditions, the apparatus comprising:

a fireproof material having sufficient size when unfolded and deployed to cover a significant section of the structure in a deployed configuration, the fireproof material including at least a first edge;

an elongated rigid circular element wherein the fireproof material is coupled to the rigid circular element along the first edge, the rigid circular element being adapted to support the fireproof material when the fireproof material is rolled up on to the rigid circular element in an undeployed configuration; and a generally rigid housing, the housing enclosing the rigid circular element and the fireproof material in the undeployed configuration, and the housing adapted for being mounted to the structure, the housing further including a plurality sides, at least three sides of the plurality of sides being configured to collapse and lay substantially flat against a surface of the structure when in the deployed configuration; and wherein the rigid circular element is rotatably coupled with the housing.

2. The apparatus of claim 1, wherein the apparatus is configured for mounting to a roof of the structure with an axis of the rigid circular element being generally perpendicular to a roof ridge of the roof, and wherein fireproof material is configured for deployment on a roof of the structure, the fireproof material including at least a roof ridge flap, the roof ridge flap being (1) adapted to cover the roof ridge adjacent the section when in the deployed configuration, and (2) folded over along a first fold line onto the fireproof material when in the undeployed configuration, the first fold line being substantially parallel to the adjacent roof ridge.

3. The apparatus of claim 2, wherein the fireproof material further includes at least one eaves flap, the eaves flap being (1) adapted to overlap eaves of the structure adjacent the section when in the deployed configuration, and (2) folded over along a second fold line onto the fireproof material when in the undeployed configuration, the second fold line being substantially parallel to the adjacent eaves.

4. The apparatus of claim 3, wherein the fireproof material further includes at least one gable end flap, the gable end flap being (1) adapted to substantially overlap and cover a gabled end of the structure, and (2) folded over along a third fold line onto the fireproof material when in the undeployed configuration, the third fold line being substantially perpendicular to the roof ridge.

5. The apparatus of claim 4, wherein the third fold line is located proximate the first edge and wherein the gable end flap covers the rigid circular element when in the deployed configuration.

6. The apparatus of claim 1, wherein the fireproof material substantially covers the collapsed sides of the housing and the rigid circular element when in the deployed configuration.

7. The apparatus of claim 1, further comprising a spring mechanism for biasing the rigid circular relative to the housing wherein the spring mechanism assists in the retraction of the fireproof material from the deployed to the undeployed configuration.

8. A system comprising a plurality of apparatus of claim 1, wherein the edges of the fireproof material other than the first edge of each apparatus include connectors for joining the edges with adjacent edges of the fireproof material of other apparatus of the plurality of apparatus to substantially enclose the entirety of the structure including the housings and the rigid circular elements of the plurality of apparatus.

9. The apparatus of claim 2, wherein the fireproof material includes a pouch formed therein to receive a dormer when the apparatus is in the deployed configuration.

10. The apparatus of claim 1, wherein the three or more sides are interconnected with each other through hinges.

11. A building structure having a roof with two of more fireproofing apparatus mounted to the roof for substantially completely covering the roof, each of the two or more fireproofing apparatus comprising:

an elongated rigid circular element rotatably coupled with the roof wherein an axis of the rigid circular element is generally perpendicular to the length of a roof ridge;

a fireproof material having a first edge, the fireproof material being attached to the rigid circular element along the first edge, and wherein the fireproof material is adapted to (1) be rolled up onto the rigid circular element when in a undeployed configuration, and (2) cover a section of the roof when in a deployed configuration.

12. The building structure of claim 11, wherein the two or more fireproofing apparatus comprises four apparatus, a first two apparatus of the four apparatus being mounted to the roof on one side of the roof ridge and a second two apparatus of the four apparatus being mounted to the roof on the other side of the roof ridge, one apparatus of the first two apparatus being mounted to the roof proximate a first roof edge above a first gabled end of the building structure with another apparatus of the first two apparatus being mounted on an opposite second roof edge above an opposite second gabled end.

13. The building structure of claim 12, wherein a front edge of one fireproof material of the one apparatus of the first two apparatus meets a front edge of another fireproof material of the other apparatus of the first two apparatus, the front edge of the one fireproof material being spaced from, substantially parallel to, and opposite the front edge of the other fireproof material, and wherein the one fireproof material and the other fireproof material both include connectors proximate their respective front edges for joining with each other.

14. The building structure of claim 11 further comprising at least four additional fireproofing apparatus mounted underneath eaves of the building structure, the additional fireproofing apparatus each including a housing containing a rigid circular element rotatably mounted therein and a fireproof material connected to the rigid circular element, wherein the fireproof material of each of the at least four additional fireproofing apparatus extend from the housing to a ground surface when the fireproof material is deployed.

15. The building structure of claim 14, wherein adjoining edges of the fireproof material from each of the two or more fireproofing apparatus mounted to the roof and each of the at least four additional apparatus mounted underneath the eaves overlap and include connectors for securing the adjoining edges, whereby the substantial entirety of the building structure is cover with fireproof material.

16. The building structure of claim 15, wherein sides of the housing of each of the two or more fireproofing apparatus mounted to the roof and of each of the at least four additional apparatus mounted underneath the eaves are collapsible, and wherein the sides of each housing rest against one of walls and the roof of the building structure when collapsed.

17. A fireproof cover apparatus for shielding a structure during wildfire conditions, the apparatus comprising:

a fireproof material having deployed and undeployed configurations, the fireproof material being of sufficient size to cover a section of a structure in the deployed configuration, and the fireproof material including at least a first edge;

an elongated rigid circular element wherein the fireproof material is coupled to the rigid circular element along the first edge, the rigid circular element being adapted to support the fireproof material when the fireproof material is rolled up on to the rigid circular element in the undeployed configuration;

a housing, the housing substantially enclosing the rigid circular element and being adapted for fixedly mounting to the building structure;

a mechanism for rotatably coupling the rigid circular element to the housing, the mechanism further including a spring to assist in the retraction of the fireproof material from the deployed configuration to the undeployed configuration; and wherein the fireproof material substantially completely covers the housing and rigid circular element when in the deployed configuration.

18. The apparatus of claim 17, wherein the housing comprises a plurality of hingeably interconnected sides, the sides being collapsible to lay flat against the structure when in the deployed configuration.

19. The apparatus of claim 17, wherein the fireproof material comprises (1) a roof ridge flap to cover a roof ridge of the structure when in the deployed configuration, (2) a eave flap to overlap eaves of the structure when in the deployed configuration, and (3) a gable end flap to cover a gable end of the structure, and wherein each of the flaps are folded onto the fireproof material when in the undeployed configuration.

* * * * *